United States Patent [19]

Nero

[11] Patent Number: 4,591,819

[45] Date of Patent: May 27, 1986

[54] INDUCTANCE ADJUSTMENT FOR TRANSFORMERS

[75] Inventor: Leroy W. Nero, Indianapolis, Ind.

[73] Assignee: RCA Corporation, Princeton, N.J.

[21] Appl. No.: 717,255

[22] Filed: Mar. 28, 1985

[51] Int. Cl.[4] ..... H01F 17/06; H01F 41/02

[52] U.S. Cl. ..... 336/178; 29/606; 29/607

[58] Field of Search ..... 310/192; 336/178, 165, 336/134, 210, 219; 29/605, 606, 607, 602 R

[56] References Cited

U.S. PATENT DOCUMENTS

| | | | |
|---|---|---|---|
| 2,350,029 | 5/1944 | Glass, Jr. | 336/178 |
| 2,494,180 | 1/1950 | Koubek | 336/178 X |
| 3,609,615 | 9/1971 | Parker | 336/178 |
| 3,665,288 | 5/1972 | Godawski | 321/24 |
| 3,671,903 | 6/1972 | Arrington et al. | 336/96 |
| 4,095,206 | 6/1978 | Hishiki | 336/178 X |
| 4,305,056 | 12/1981 | Mochida et al. | 336/178 |

FOREIGN PATENT DOCUMENTS

| | | | |
|---|---|---|---|
| 1085850 | 10/1967 | United Kingdom | 336/178 |

*Primary Examiner*—Thomas J. Kozma

*Attorney, Agent, or Firm*—Paul J. Rasmussen; Joseph Laks; Scott J. Stevens

[57] ABSTRACT

A core gap spacing arrangement for a transformer includes a length of twisted wire pair. The twisted pair has a relatively low packing density and is therefore compressible over a large range by using relatively low compression forces, resulting in greater ability to accurately adjust the inductance of the transformer primary winding.

7 Claims, 6 Drawing Figures

INDUCTANCE ADJUSTMENT FOR TRANSFORMERS

This invention relates to arrangements for adjusting the inductance of transformers and, in particular, to core gap adjustments for high voltage transformers.

In a resonant retrace deflection system including a high voltage transformer, such as is used in many television receivers and computer monitors, the inductance of the high voltage transformer primary winding is adjusted in order to meet specifications with respect to, for example, retrace time, high voltage level, and high voltage output impedance. Improper adjustment of the primary winding inductance may therefore result in degraded performance of the transformer and associated circuitry.

In a typical high voltage transformer, the primary winding is wound on a cylindrical bobbin. A magnetically permeable core is inserted into the bobbin so that the bobbin and the winding surrounds a portion of the core. The core may be constructed of two pieces such that an air gap is formed between the core pieces inside the coil bobbin. Adjustment of the air gap spacing is then used to control the primary winding impedance.

The core air gap spacing is often achieved by using materials such as paper or mylar, which provide a substantially fixed gap spacing. The gap dimension may be varied somewhat by compressing the spacing material in order to adjust the winding inductance, but the range of adjustment is small since the spacing material is not easily compressed and requires a great deal of force. This complicates the arrangement necessary to hold the compressed core portions together in order to maintain the proper gap spacing and prevent creep as the spacing material seeks to return to its uncompressed state. It is known in the prior art to use a length of solid wire as a gap spacer. Wire is difficult to compress however, and becomes increasingly more difficult to compress as it becomes flattened and crushed.

It is desirable to provide a simplified arrangement for adjusting and maintaining the core gap spacing, and hence the inductance, of a transformer winding. It is also desirable to provide a significant gap spacing adjustment range in order to insure that correct setting of the winding inductance is possible over wide component tolerance ranges.

In accordance with the present invention, a transformer comprises a magnetically permeable core with a coil of wire disposed about the core to form a transformer winding. The core comprises first and second core portions with spacing material comprising a length of twisted wire pair disposed between the core portions to form a gap. The twisted wire pair is deformed to provide adjustment of the inductance of the transformer winding.

In the accompanying drawing

Figure 1:
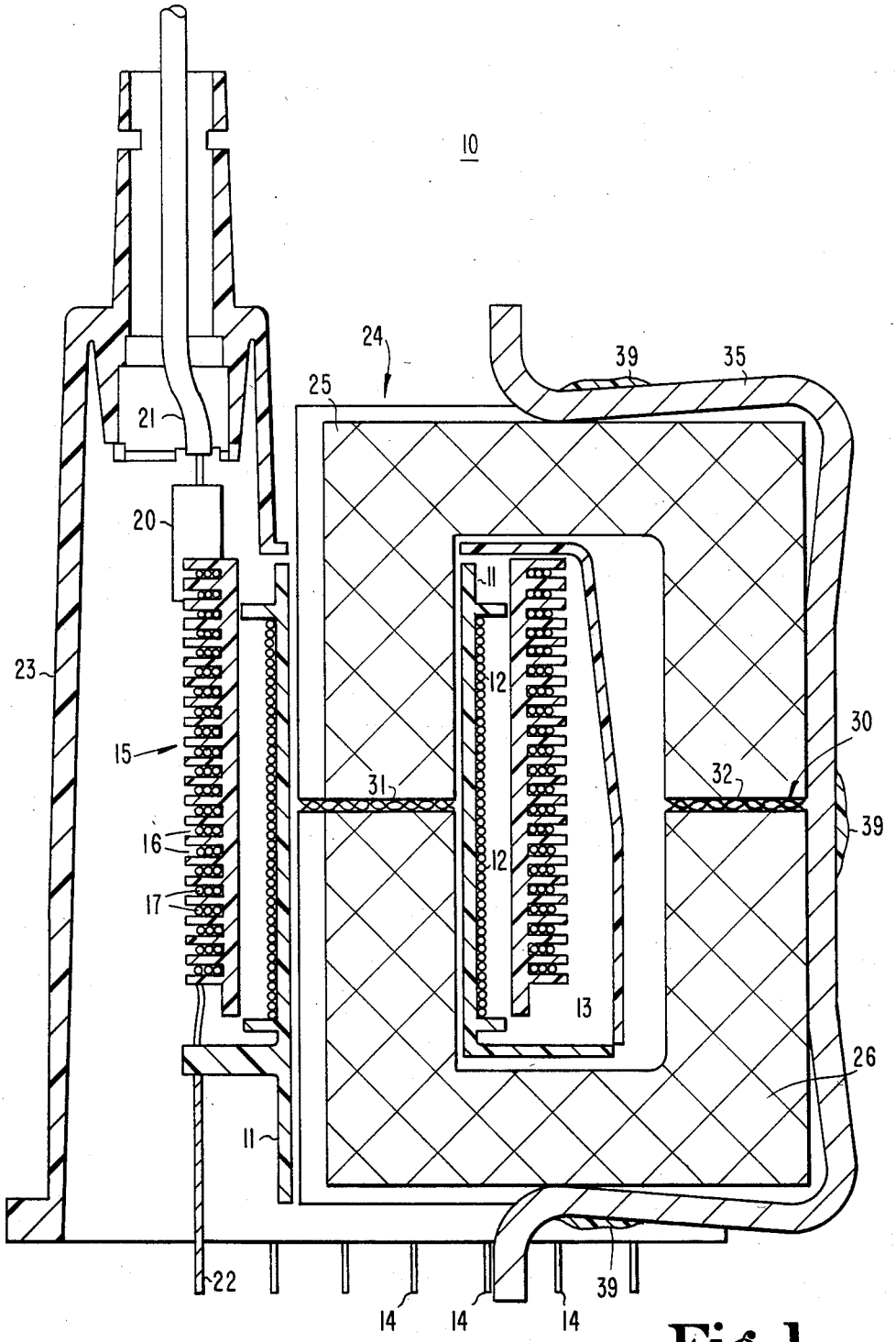
FIG. 1 is a cross sectional elevational view of a transformer constructed in accordance with the present invention.

FIG. 1 illustrates a transformer 10, specifically a high voltage transformer, for use in video display apparatus such as a television receiver or a computer monitor. Transformer 10 includes a primary winding bobbin 11, about which is wound one or more transformer primary windings 12, each of which may comprise one or more layers of wire, to form a primary winding assembly 13. Bobbin 11 of FIG. 1 is illustratively shown as being cylindrical. Bobbin 11 also incorporates at least one electrical terminal post 14 to which the primary winding 12 is connected.

A cylindrical tertiary winding bobbin 15 surrounds the primary winding assembly 13. Bobbin 15 incorporates a number of winding slots 16 which receive a plurality of wire winding layers which form the transformers tertiary winding 17. In the transformer shown in FIG. 1, tertiary winding 17 produces the high voltage or anode potential which is applied from one terminal of the tertiary winding 17 to the anode terminal of a cathode ray tube (not shown) via a resistor 20 and an anode lead 21. Another terminal of the tertiary winding 17 is connected to electrical terminal post 22.

The tertiary winding assembly, comprising bobbin 15 and tertiary winding 17, and the primary winding assembly 13, are located within a transformer cup 23. Transformer cup 23 is ordinarily filled with an epoxy or other material (not shown) in order to pot the primary and tertiary windings to insure reliable operation of the transformer.

A low reluctance path for flux generated by the primary winding 12 is provided by a magnetically permeable ferrite core 24, which is illustratively composed of two C-shaped core segments 25 and 26. One leg of each of core segments 25 and 26 is received within the interior of primary winding bobbin 11, which is left free of potting material when the primary and tertiary windings are potted. The remaining legs of core segments 25 and 26 are located outside the cup 23.

In a typical circuit application, transformer 10, in addition to providing a high voltage level, may be used in combination with a resonant retrace deflection circuit which provides scanning or one or more electron beams across the phosphor display screen of a cathode ray tube. The magnitude of the high voltage level and the timing of the electron beam trace and retrace intervals are in part determined by the inductance of primary winding 12. Proper operation of the video display apparatus requires careful regulation of the high voltage level and the trace and retrace intervals. This in turn requires that the inductance of primary winding 12 be adjustable to a closely specified value and that the inductance value be maintained to close tolerances over a period of time during normal operation of the transformer.

Figure 2:
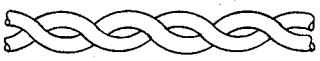
FIG. 2 is a top plan view of a core gap spacer in accordance with an aspect of the present invention.
Figure 3:
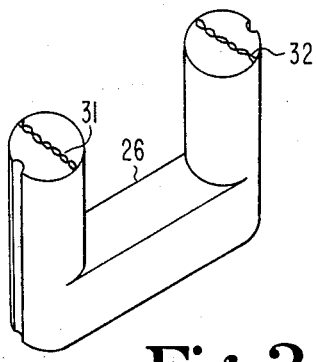
FIG. 3 is a top plan view of a portion of a transformer core section illustrating the core gap spacer of FIG. 2 in place.

In the transformer of FIG. 1, the primary winding inductance is set by adjusting the dimension of the air gap 30 between core segments 25 and 26. In accordance with the present invention, a core gap spacing arrangement comprises length of wire 31 and 32 in a twisted pair configuration, such as is shown in FIG. 2, located between adjacent core legs of core segments 25 and 26. FIG. 3 illustrates a preferred orientation of the twisted wire pair lengths 31 and 32 on the ends of the legs of core segment 26. The wire pair lengths 31 and 32 are oriented perpendicular to the portion of core segment 26 that separates the legs of core segment 26. This orientation provides stability between the core segments 25 and 26 when the transformer is assembled.

The use of twisted pair lengths as a core gap spacing structure permits a much greater range of winding inductance adjustment than was possible using such previously known techniques of the prior art such as mylar or a single wire. The variablity of the core material in terms of dimensions and electrical properties, e.g., permeability, due to firing of the ferrite core material causes difficulty in predicting the needed core gap spacing for a desired winding inductance. With a fixed spacing material, such as paper or mylar, the range of spacer compressibility is relatively small and the compression force is great, thereby subjecting the core to potentially damaging and characteristic-changing compression stresses while the inductance adjustment is being made. The use of a length of single wire as a spacing material presents the same problem, as copper or aluminum wire is not easily crushed or deformed.

Figure 4A:
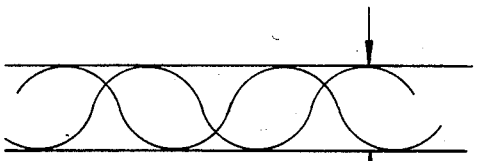
FIG. 4A is a schematic illustration of the core gap spacer shown in FIG. 2, in a non-compressed condition.
Figure 4B:
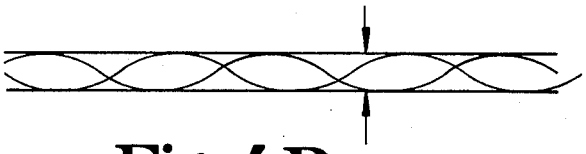
FIG. 4B is a schematic illustration of the core gap spacer shown in FIG. 2, in a compressed condition.

The length of twisted wire pair, such as illustrated in FIG. 2, for example, provides a core gap spacer that gives a large adjustment range and does not require undesirably large compression forces. The large adjustment range is provided as a result of the material packing geometry inherent in the twisted pair. As can be illustratively seen in FIGS. 4A and 4B, in an exaggerated manner, the twisted wire pair in a non-compressed condition, as shown in FIG. 4A, has a relatively low packing density, such that a considerable amount of compression of the pair structure may take place, as shown in FIG. 4B, without significantly deforming or compressing the individual wires of the twisted pair. The wires of the twisted pair will therefore bend, rather than be flattened, which requires much less force. This permits the twisted pair to be compressed over a much greater range and use much lower compression forces than are necessary with a conventional gap spacer, such as mylar or paper. The force needed to maintain the twisted pair in a compressed state is also much lower than that required with a conventional gap spacer, thereby simplifying the structure needed to hold the transformer together.

Figure 5:
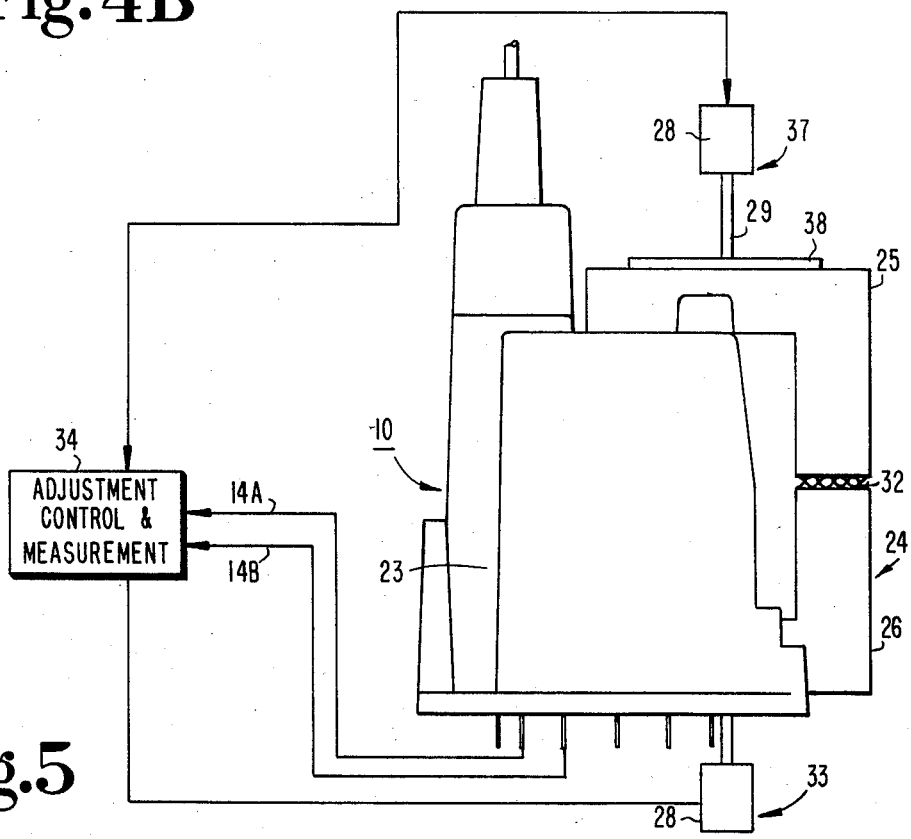
FIG. 5 is a schematic and block diagram of a transformer winding inductance asjustment system.

The previously described advantages of the twisted pair core gap spacer also permits the assembly of the transformer to be more highly automated than was possible with a conventional gap spacer. FIG. 5 illustrates an arrangement in accordance with a feature of the invention for adjusting the inductance of the transformer primary winding by adjusting the core gap spacing. Prior to placement in the adjusting apparatus, the transformer is assembled by winding and potting the windings. The ends of the core segments and/or the twisted wire pair is coated with an adhesive, for example by dipping or spraying. The twisted pair gap spacer is placed on the ends of the legs of core segments 25 or 26 and is cut to the desired length. The coating of adhesive maintains the length of twisted pair in place. The core segments 25 and 26 are then placed within bobbin 10, resulting in an arrangement such as is partially shown in FIG. 3.

The assembled transformer is then placed in the inductance adjustment apparatus as shown in FIG. 5. The adjustment apparatus comprises one or more adjusters 33, each of which illustratively comprise a stepping motor 28, controlled by adjustment control and measurement circuit 34. The stepping motors are energized such that force is applied to core segments 25 and 26 via a rod 29 and plate 38 in order to compress the twisted pair gap spacer. Primary winding leads **14*a* and 14*b* are connected to adjustment control and measurement circuit 34. The primary winding is energized and the inductance is monitored by adjustment control and measurement circuit 34 while the twisted pair gap spacer is being compressed. When the desired inductance is attained, the position of the core segments is maintained by the placement of a spring-type core clip 35, shown in FIG. 1. An adhesive 39, as shown in FIG. 1, may be applied to the core surface and/or the core clip to aid in maintaining the desired position of core segments 25 and 26**.

Because of the relatively low compression force required to compress the twisted pair gap spacers due to the packing density of the twisted pair geometry, core clip 35 may advantageously be placed on the core before adjustment of the core gap. The spring tension of core clip 35 is sufficient to hold the core segments in position once the desired gap spacing is achieved.

As previously described, the twisted pair gap spacer provides a large inductance adjustment range. By selecting the gauge of the wire comprising the twisted pair, the particular range of possible gap spacing may be chosen to accommodate different requirements of different circuits with which the transformer is to be used. Transformer 10 illustratively utilizes enameled copper wire as the twisted pair gap spacers, having wire gauge sizes in the range of #29 to #35.

The previously described core gap spacing arrangement has been described with reference to a high voltage transformer such as that used in video display apparatus. The use of twisted pair core gap spacers, however, is applicable to any transformer application and may aid in controlling the transformer power transfer and leakage inductance to closer tolerances.

What is claimed is:

1. A transformer comprising:

a magnetically permeable core; and a coil of wire disposed about said core in order to form a transformer winding, said core comprising:

a first core portion;

a second core portion; and spacing means comprising a length of twisted wire pair disposed between said first and second core portions to form a gap therebetween, said twisted wire pair being deformed to provide adjustment of the inductance of said transformer winding.

2. The arrangement defined in claim 1, wherein said first and second core portions are maintained with said twisted wire pair therebetween by way of a spring-type core clamp.

3. The arrangement defined in claim 1, wherein deforming of said twisted wire pair increases the packing density of said twisted wire pair.

4. A method for assembling and adjusting the inductance of an inductive element comprising the steps of:

winding a plurality of wire turns to form a winding;

placing a magnetically permeable core in the vicinity of said winding, said core comprising first and second core segments;

locating a length of twisted wire pair between said first and second core segments; and compressing said twisted wire pair to increase the packing density thereof in order to adjust the inductance of said inductive element.

5. The method defined in claim 4, wherein the inductance of said inductive element is measured while said twisted wire pair is compressed.

6. The method defined in claim 4, further comprising the step of placing a core retaining clip on said magnetically permeable core in order to maintain the relative position of said first and second core segments.

7. The method defined in claim 4, wherein a core retaining clip is placed on said core prior to compressing said twisted wire pair.

* * * * *